US008269087B1

(12) United States Patent
Davis

(10) Patent No.: US 8,269,087 B1
(45) Date of Patent: Sep. 18, 2012

(54) MUTE

(76) Inventor: Donald A. Davis, McDonough, GA (US)

( * ) Notice: Subject to any disclaimer, the term of this patent is extended or adjusted under 35 U.S.C. 154(b) by 0 days.

(21) Appl. No.: 13/178,474

(22) Filed: Jul. 7, 2011

(51) Int. Cl.
*G10D 9/06* (2006.01)

(52) U.S. Cl. ..... 84/400

(58) Field of Classification Search ..... 84/400
See application file for complete search history.

(56) References Cited

U.S. PATENT DOCUMENTS

| | | | | | |
|---|---|---|---|---|---|
| 1,033,307 | A | * | 7/1912 | Elrod | 84/400 |
| 1,445,115 | A | * | 2/1923 | Turner | 84/400 |
| 1,508,024 | A | * | 9/1924 | McArthur | 84/400 |
| 1,574,287 | A | * | 2/1926 | Hoffman | 84/400 |
| D71,649 | S | * | 12/1926 | Magosy | D17/13 |
| 1,714,513 | A | * | 5/1929 | Magosy | 84/400 |
| 1,776,216 | A | * | 9/1930 | Davis | 84/400 |
| 2,252,847 | A | * | 8/1941 | Greenspan | 84/400 |
| 2,470,597 | A | * | 5/1949 | Woodward | 84/400 |
| 2,574,591 | A | * | 11/1951 | Rudd | 84/723 |
| 2,575,795 | A | * | 11/1951 | Chenava | 84/400 |
| 3,016,782 | A | * | 1/1962 | Laas | 84/453 |
| 3,392,619 | A | * | 7/1968 | Hill | 84/400 |
| 3,429,215 | A | * | 2/1969 | Finch | 84/400 |
| D223,726 | S | * | 5/1972 | Crown | D17/13 |
| 3,760,679 | A | * | 9/1973 | Gossick et al. | 84/400 |
| D234,875 | S | * | 4/1975 | Beversdorf | D17/13 |
| D258,215 | S | * | 2/1981 | Berg | D17/13 |
| 4,273,021 | A | * | 6/1981 | Mackie | 84/400 |
| 4,998,959 | A | * | 3/1991 | Purdie | 84/400 |
| 5,309,808 | A | * | 5/1994 | Tarrant | 84/400 |
| 5,373,771 | A | * | 12/1994 | Weik et al. | 84/400 |
| 5,488,893 | A | * | 2/1996 | Lewis et al. | 84/400 |
| D484,174 | S | * | 12/2003 | Collins | D17/13 |
| 7,049,501 | B2 | * | 5/2006 | Shellhammer et al. | 84/400 |

* cited by examiner

*Primary Examiner* — David Warren
*Assistant Examiner* — Robert W Horn
(74) *Attorney, Agent, or Firm* — Michael J. Bootcheck, LLC

(57) ABSTRACT

A mute for a horn-type musical instrument is disclosed. The mute having a freely resonating body including an opening therein to permit air flow into the body, the body having n number of first facets wherein n is an integer from 3 to 99 and having o number of second facets wherein o is an integer from 1 to 99. The mute changes the timbre of the sound generated by the instrument, yet maintains the majority of the volume of sound prior to placement of the mute into the bell.

13 Claims, 16 Drawing Sheets

MUTE

FIELD OF THE INVENTION

This invention relates to a mute for a musical instrument. More particularly, the invention relates to a mute which can be removable positioned into the bell portion of a horn-type instrument which changes the timbre of the sound generated by horn-type instrument yet maintains the majority of the presence or volume of the sound present prior to the placement of the mute into the instrument.

BACKGROUND OF THE INVENTION

A mute is a device that deadens, dampens or changes the color of the sound generated by a musical instrument such as a horn instrument. Typically, a mute is either fit into the bell of the instrument by means of corks that stick to the inside of the bell or can be clipped around the bell. Alternatively, the player of the instrument may play into a reflective or absorbent material set on a stand in order to achieve a muting effect.

The use of mutes stems from brass instrument players using their hands in the bell of the instrument to help change the pitch of the instrument. During the 1830's musicians started to use mechanical devices as mutes to specifically change the color of the sound.

The invention disclosed herein comprises a mute which changes the timbre of the sound generated by an instrument yet maintains the majority of the presence or volume of the sound.

SUMMARY OF THE INVENTION

According to one exemplary embodiment of the present invention, the device comprises a freely resonating body including an opening therein to permit air flow into a cavity internal to the body, the body being adapted to fit at least partially into the bell of an instrument to thereby change the timbre of the sound generated by the instrument relative to the sound generated prior to placement of the mute into the bell of the instrument the body having n number of first facets wherein n is an integer from 3 to 99 and each of the first facets has a thickness of less than 1 inch and greater then 0.01 inch, the body having o number of second facets wherein o is an integer from 1 to 99 and each of the second facets has a thickness of less than 1 inch and greater then 0.01 inch, and wherein there is a central plane P about which the mute is symmetrical through a centerline of the body.

DETAILED DESCRIPTION OF THE INVENTION

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

Figure 1:
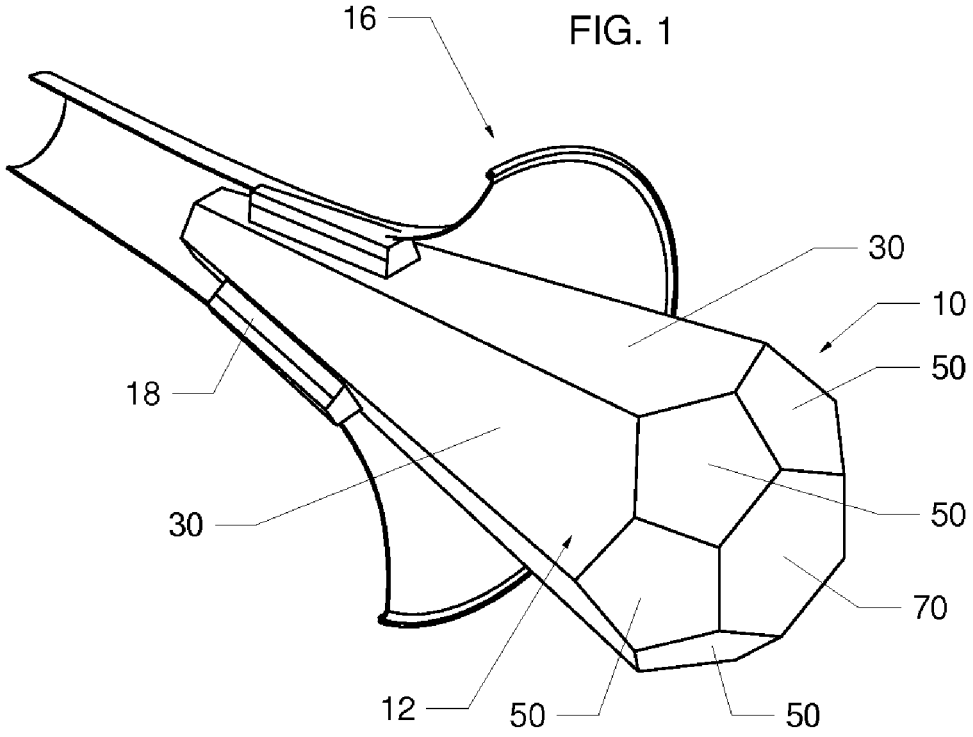
FIG. 1 illustrates a perspective view of an exemplary embodiment of the present invention in place on the bell of an instrument.
Figure 2A:
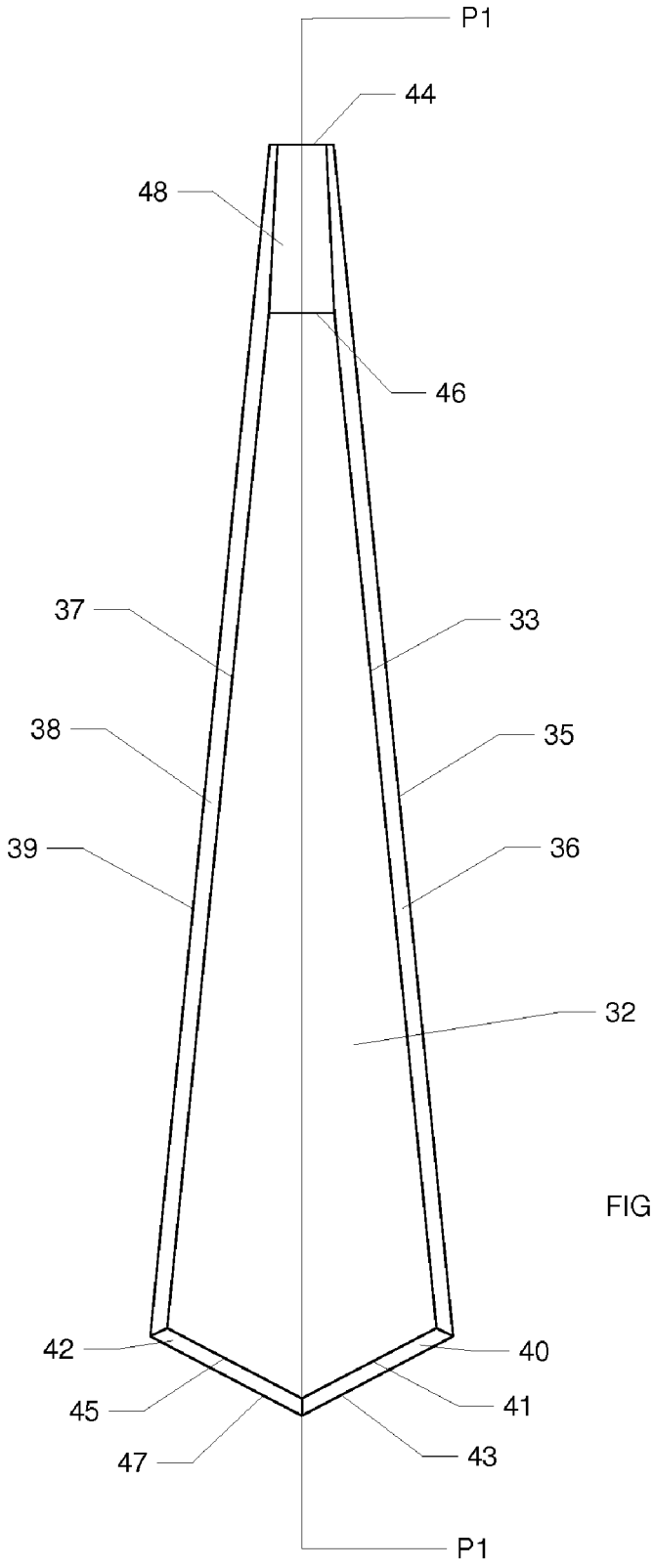
FIG. 2*a* illustrates a top view of a portion of an exemplary embodiment of the present invention.
Figure 2B:
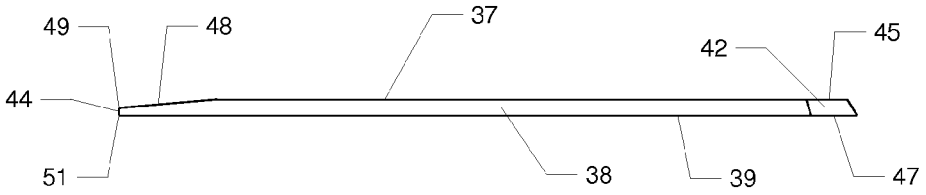
FIG. 2*b* illustrates a side view of the exemplary embodiment of FIG. 2*a;*

FIG. 1 illustrates a perspective view of an exemplary embodiment of the present invention in place on the bell of an instrument. FIG. 2*a* illustrates a top view of a portion of an exemplary embodiment of the present invention. FIG. 2*b* illustrates a side view of the exemplary embodiment of FIG.

Figure 2C:
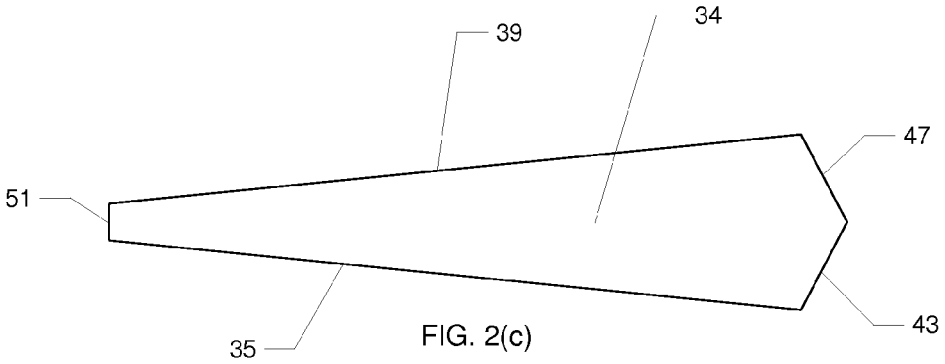
FIG. 2*c* illustrates a bottom view of the exemplary embodiment of FIGS. 2*a*-2*b;*
Figure 3A:
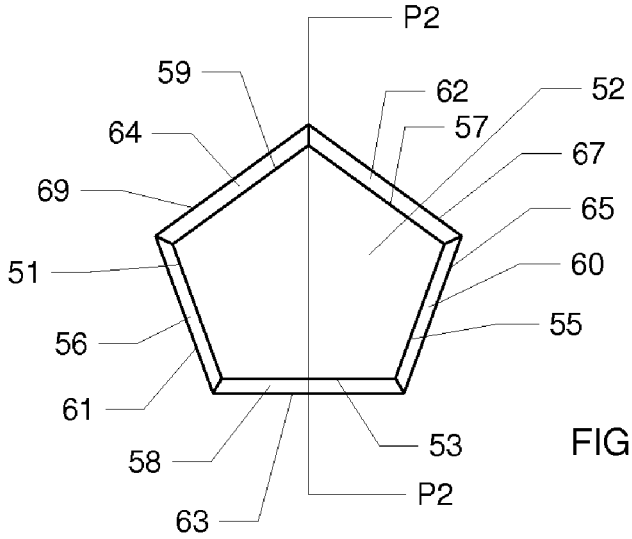
FIG. 3*a* illustrates a top view of a portion of an exemplary embodiment of the present invention.
Figure 3B:
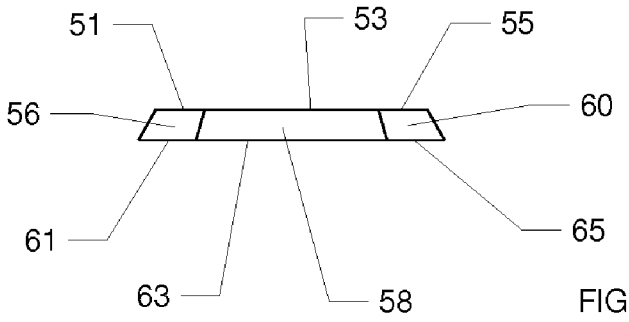
FIG. 3*b* illustrates a side view of the exemplary embodiment of FIG. 3*a;*
Figure 3C:
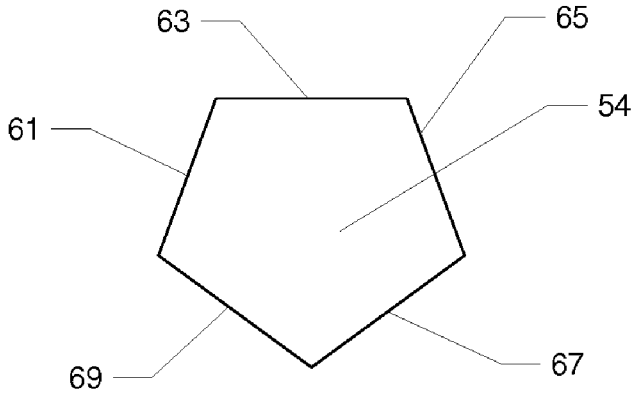
FIG. 3*c* illustrates a bottom view of the exemplary embodiment of FIGS. 3*a*-3*b;*
Figure 4A:
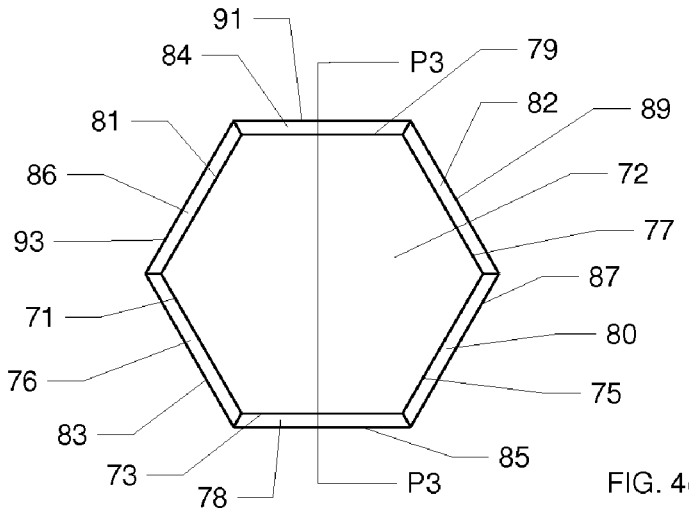
FIG. 4*a* illustrates a top view of a portion of an exemplary embodiment of the present invention.
Figure 4B:
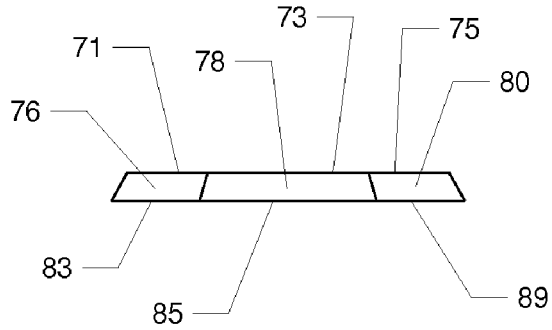
FIG. 4*b* illustrates a side view of the exemplary embodiment of FIG. 4*a;*
Figure 4C:
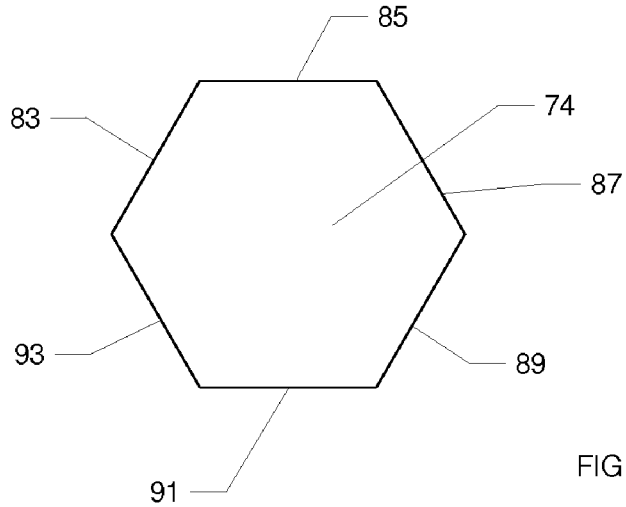
FIG. 4*c* illustrates a bottom view of the exemplary embodiment of FIGS. 4*a*-4*b;*
Figure 5:
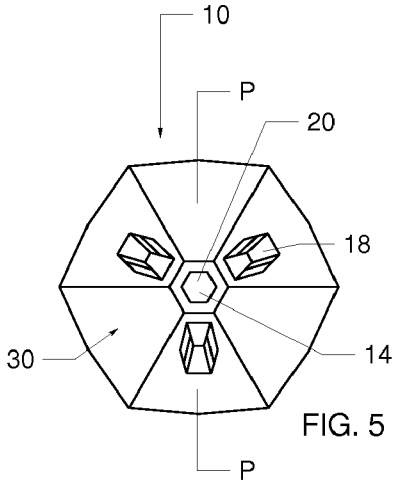
FIG. 5 illustrates a top view of an exemplary embodiment of the present invention.
Figure 6:
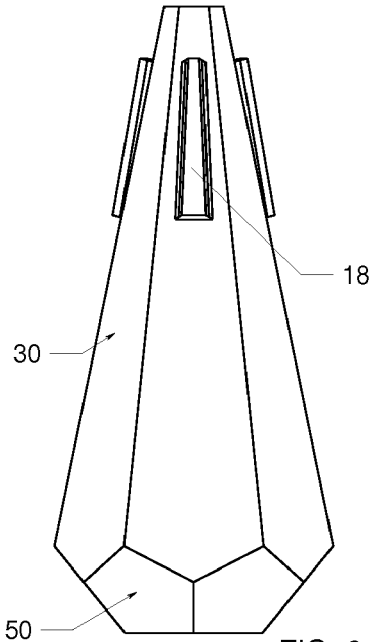
FIGS. 6-7 illustrate side views of the exemplary embodiment of FIG. 5.
Figure 7:
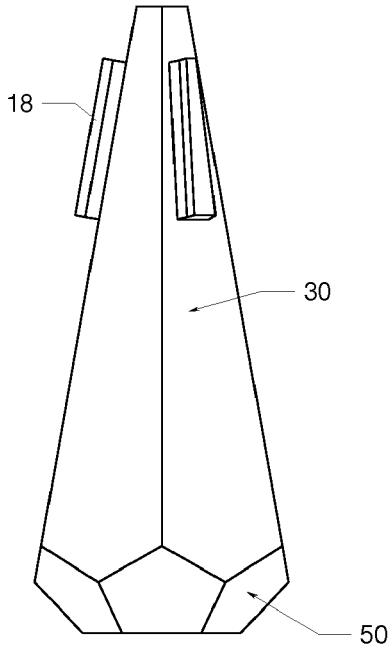
Figure 8:
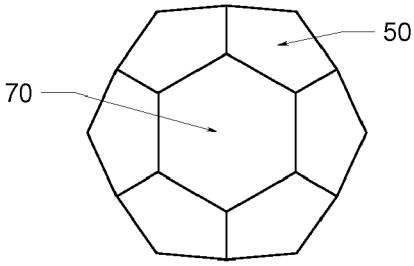
FIG. 8 illustrates a bottom view of the exemplary embodiment of FIGS. 5-7.
Figure 9:
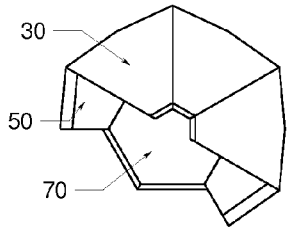
FIG. 9 illustrates a partial cut-away top view of the exemplary embodiment of FIGS. 5-8.
Figure 10:
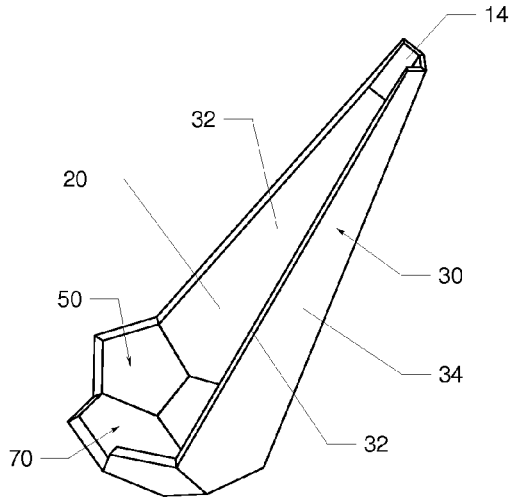
FIG. 10 illustrates a partial cut-away perspective view of the exemplary embodiment of FIGS. 5-9.
Figure 11:
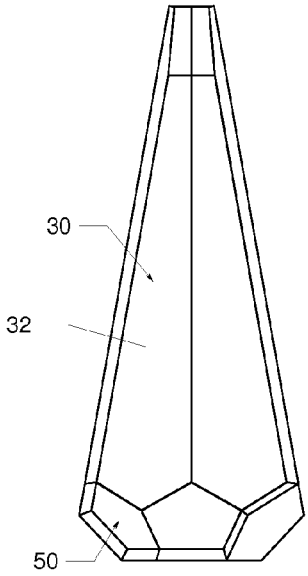
FIGS. 11-12 illustrate partial cut-away side views of the exemplary embodiment of FIGS. 5-10.
Figure 12:
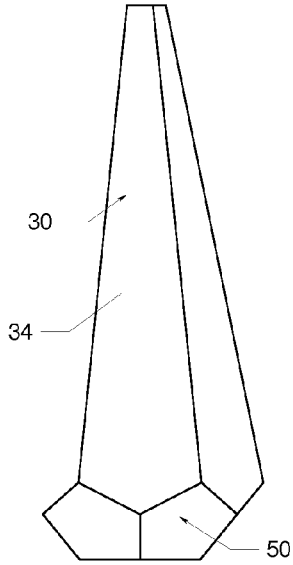
Figure 13:
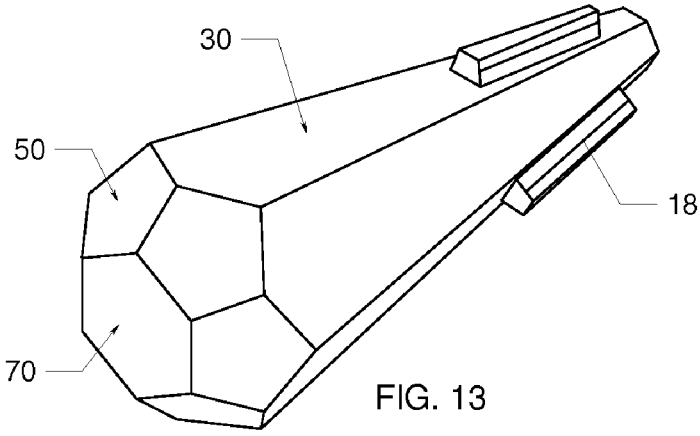
FIG. 13 illustrates a perspective view of an exemplary embodiment of the present invention.
Figure 14:
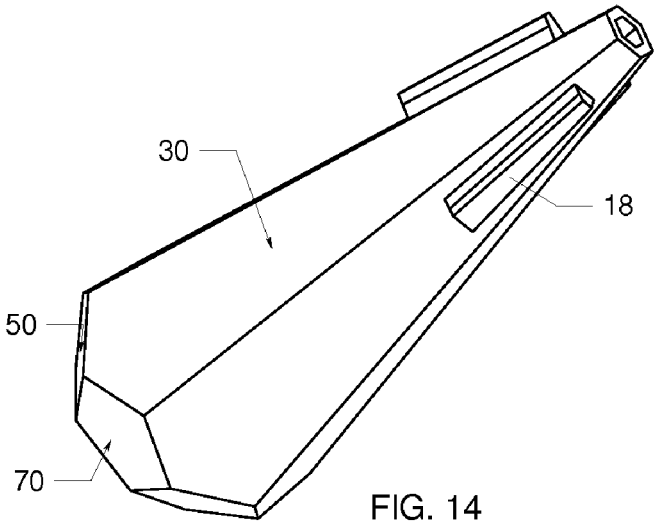
FIG. 14 illustrates another perspective view of the exemplary embodiment of FIG. 13.
Figure 15:
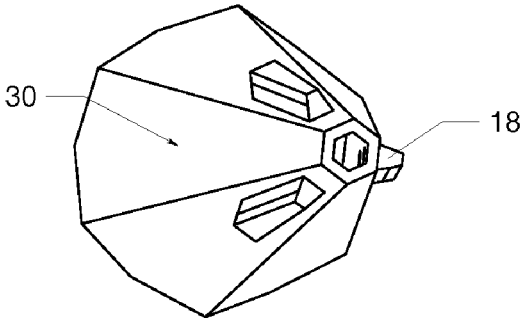
FIG. 15 illustrates a top perspective view of the exemplary embodiment of FIGS. 13-14.
Figure 16:
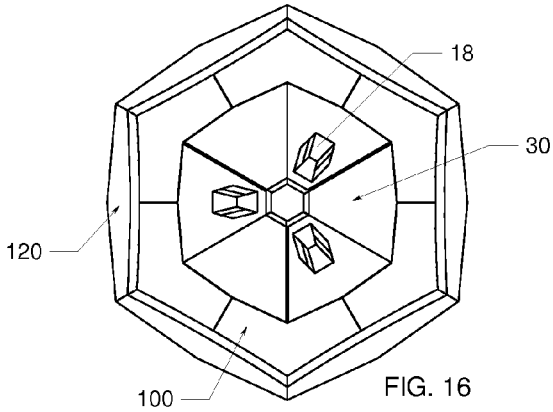
FIG. 16 illustrates a perspective view of an exemplary embodiment of the present invention.
Figure 17:
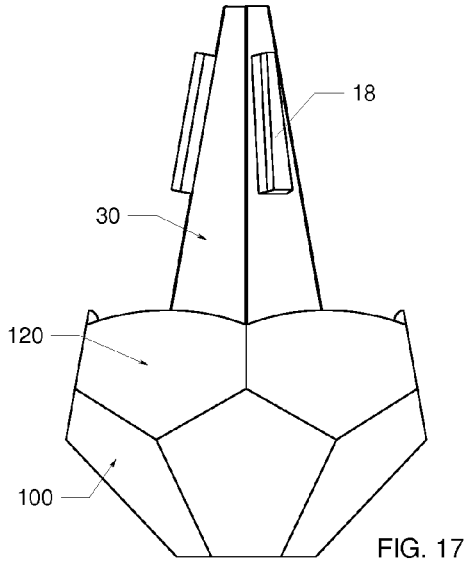
FIGS. 17-18 illustrate side views of the exemplary embodiment of FIG. 16.
Figure 18:
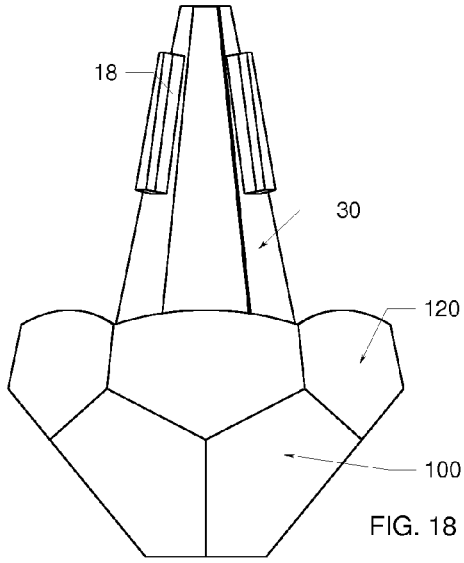
Figure 19:
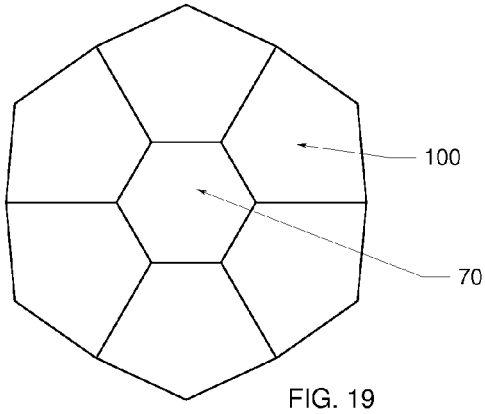
FIG. 19 illustrates a bottom view of the exemplary embodiment of FIGS. 16-18.
Figure 20:
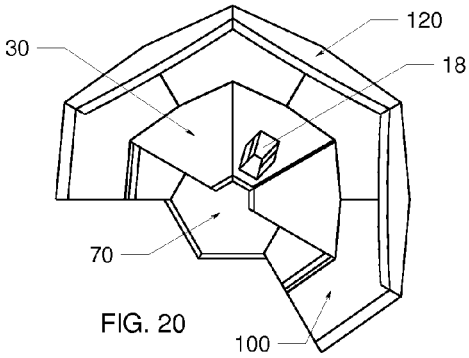
FIGS. 20-23 illustrate partial cut-away perspective views of the exemplary embodiment of FIGS. 16-19.
Figure 21:
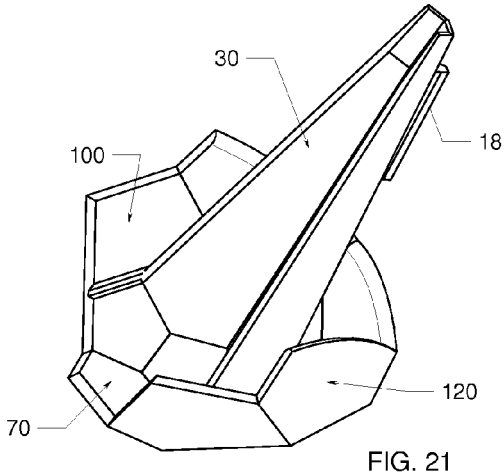
Figure 22:
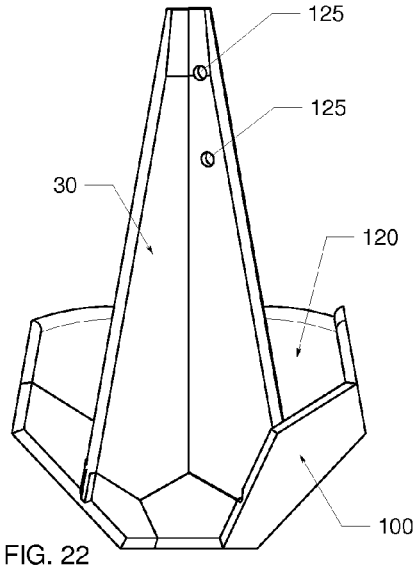
Figure 23:
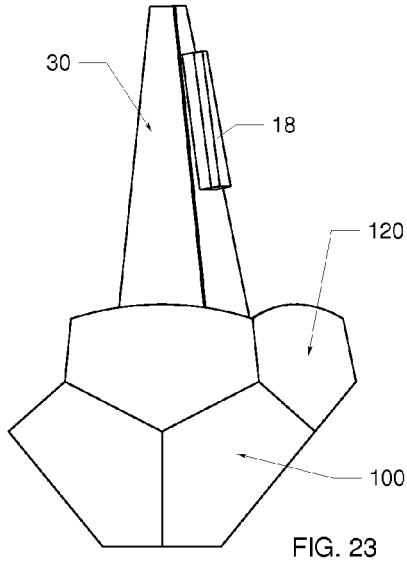
Figure 24:
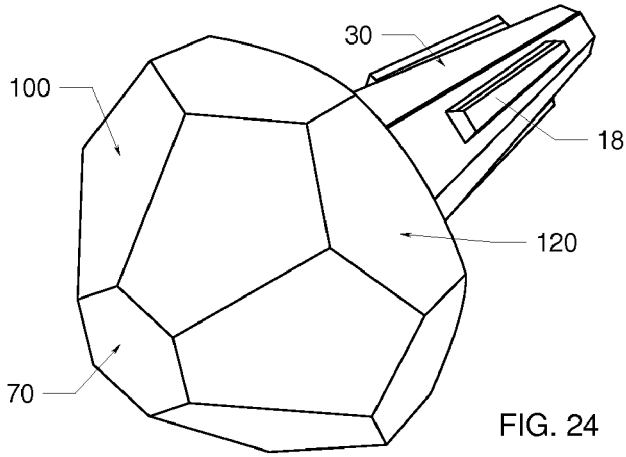
FIGS. 24-26 illustrate perspective views of the exemplary embodiment of FIGS. 16-23.
Figure 25:
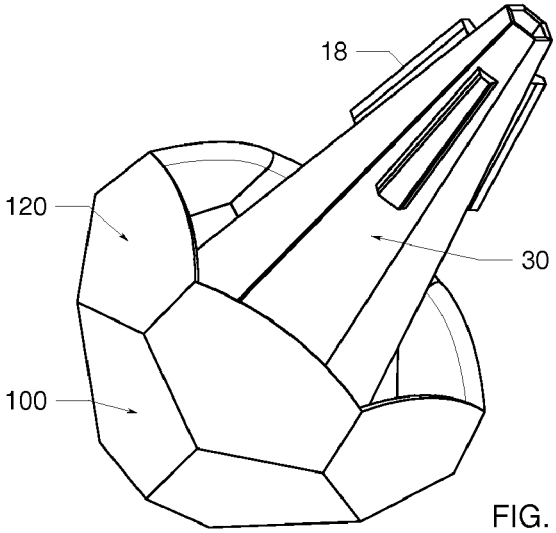
Figure 26:
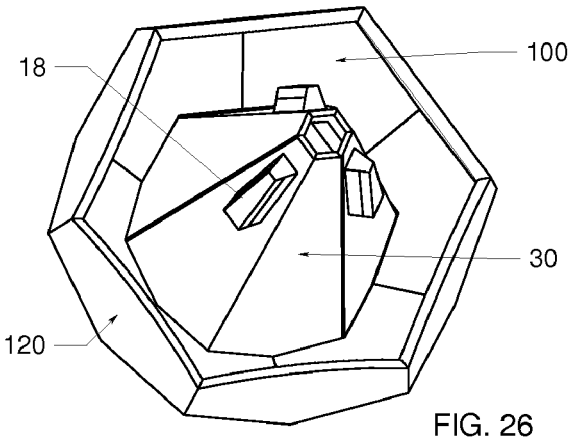
Figure 27:
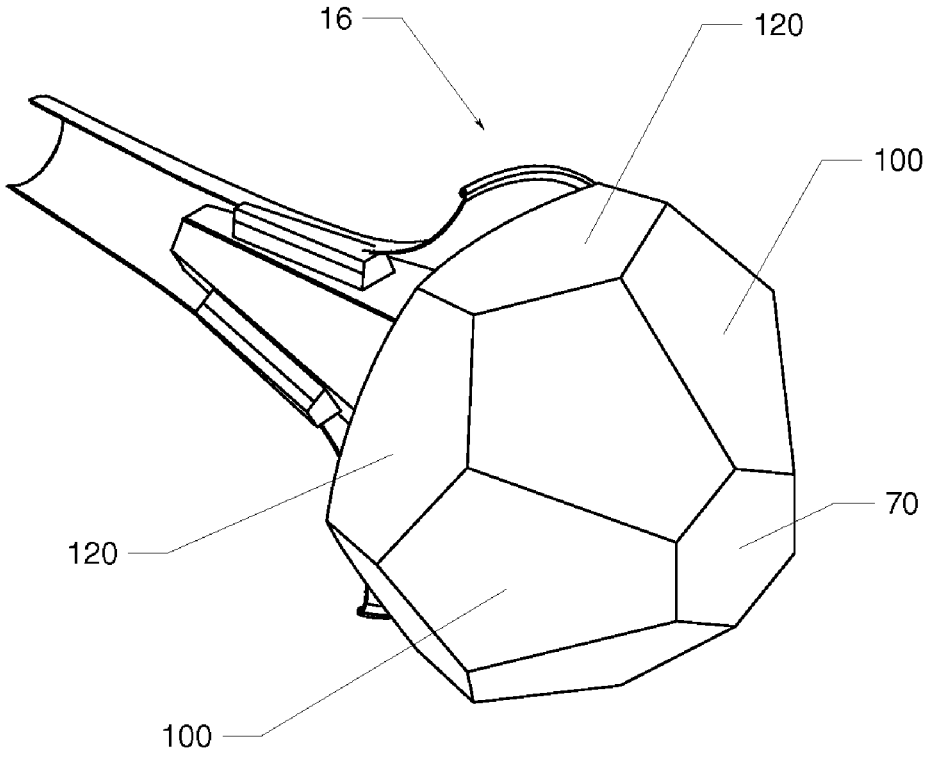
FIG. 27 illustrates a perspective view of the exemplary embodiment of FIGS. 16-26 in place on the bell of an instrument.
Figure 28A:
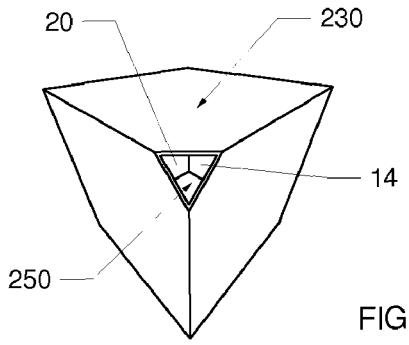
FIGS. 28(*a*)-(*c*) illustrate top, perspective, and bottom views, respectively, of another exemplary embodiment of the present invention.
Figure 28B:
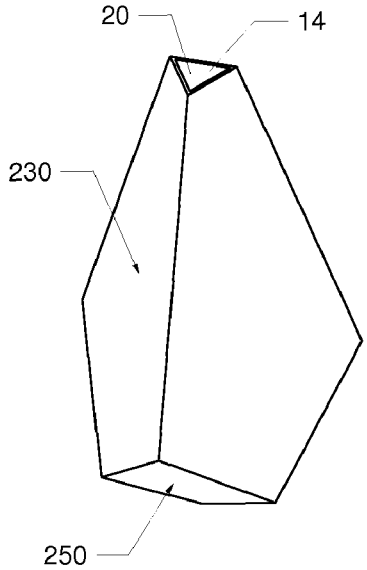
Figure 28C:
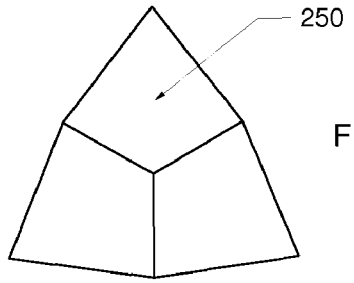
Figure 29A:
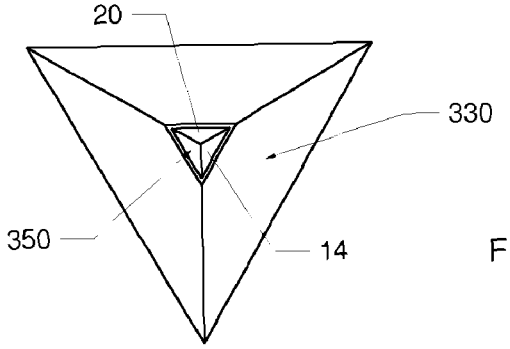
FIGS. 29(*a*)-(*c*) illustrate top, perspective, and bottom views, respectively, of another exemplary embodiment of the present invention.
Figure 29B:
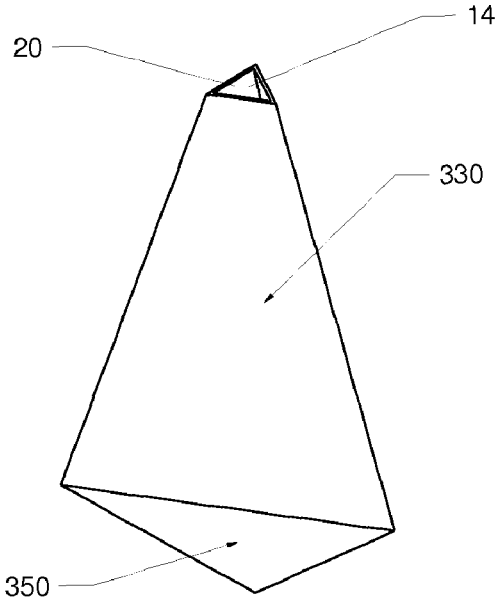
Figure 29C:
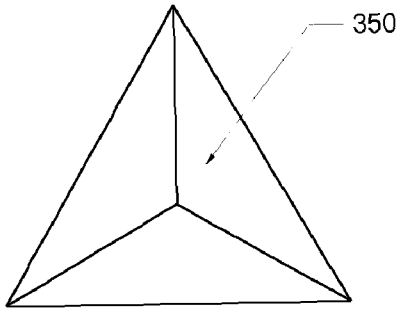
Figure 30A:
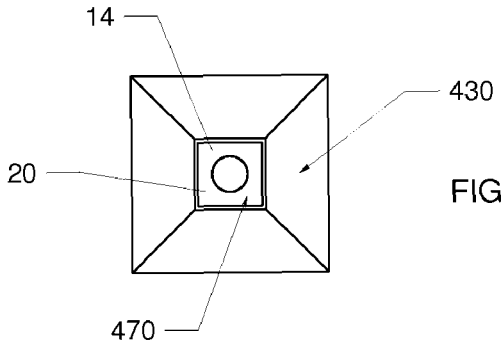
FIGS. 30(*a*)-(*c*) illustrate top, perspective, and bottom views, respectively, of another exemplary embodiment of the present invention.
Figure 30B:
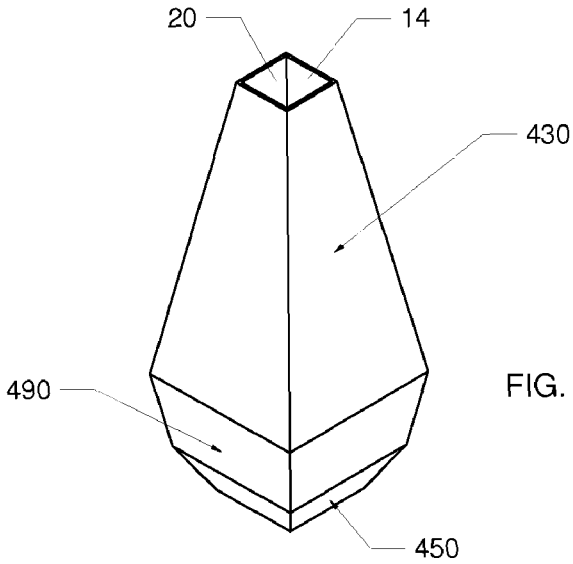
Figure 30C:
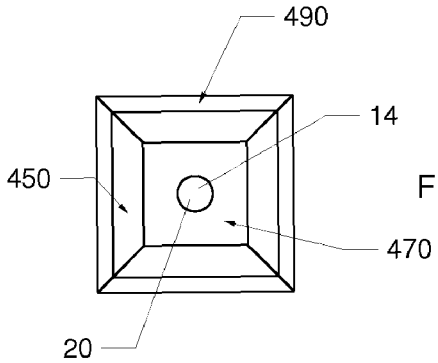
Figure 31:
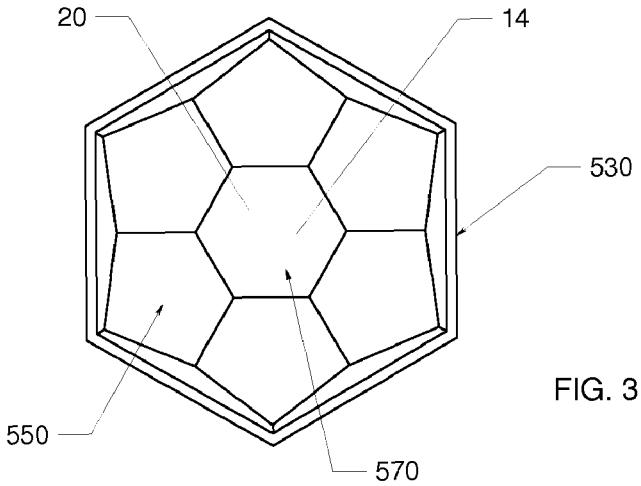
FIGS. 31-33 illustrate perspective views of another exemplary embodiment of the present invention, i.e., a plunger-mute.
Figure 32:
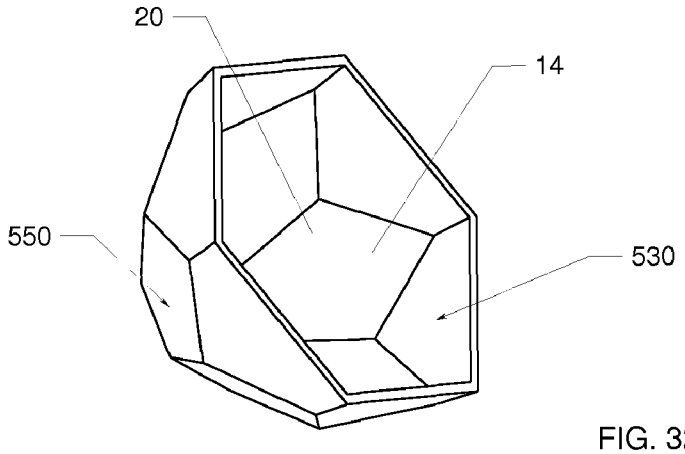
Figure 33:
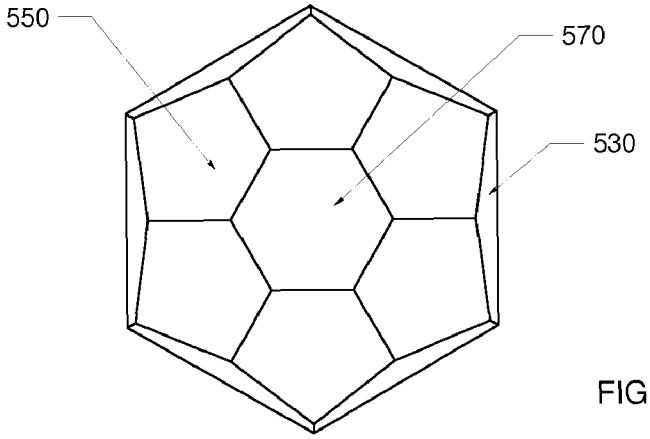

2*a*. FIG. 2*c* illustrates a bottom view of the exemplary embodiment of FIGS. 2*a*-2*b*. FIG. 3*a* illustrates a top view of a portion of an exemplary embodiment of the present invention. FIG. 3*b* illustrates a side view of the exemplary embodiment of FIG. 3*a*. FIG. 3*c* illustrates a bottom view of the exemplary embodiment of FIGS. 3*a*-3*b*. FIG. 4*a* illustrates a perspective view of a portion of an exemplary embodiment of the present invention. FIG. 4*b* illustrates a perspective view of the exemplary embodiment of FIG. 4*a*. FIG. 4*c* illustrates a perspective view of the exemplary embodiment of FIGS. 4*a*-4*b*. FIG. 5 illustrates a top view of an exemplary embodiment of the present invention. FIGS. 6-7 illustrate side views of the exemplary embodiment of FIG. 5. FIG. 8 illustrates a bottom view of the exemplary embodiment of FIGS. 5-7. FIG. 9 illustrates a partial cut-away top view of the exemplary embodiment of FIGS. 5-8. FIG. 10 illustrates a partial cut-away perspective view of the exemplary embodiment of FIGS. 5-9. FIGS. 11-12 illustrate partial cut-away side views of the exemplary embodiment of FIGS. 5-10. FIG. 13 illustrates a perspective view of an exemplary embodiment of the present invention. FIG. 14 illustrates another perspective view of the exemplary embodiment of FIG. 13. FIG. 15 illustrates a top perspective view of the exemplary embodiment of FIGS. 13-14. FIG. 16 illustrates a perspective view of an exemplary embodiment of the present invention. FIGS. 17-18 illustrate side views of the exemplary embodiment of FIG. 16. FIG. 19 illustrates a bottom view of the exemplary embodiment of FIGS. 16-18. FIGS. 20-23 illustrate partial cut-away perspective views of the exemplary embodiment of FIGS. 16-19. FIGS. 24-26 illustrate perspective views of the exemplary embodiment of FIGS. 16-23. FIG. 27 illustrates a perspective view of the exemplary embodiment of FIGS. 16-26 in place on the bell of an instrument. FIGS. 28(*a*)-(*c*) illustrate top, perspective, and bottom views, respectively, of another exemplary embodiment of the present invention. FIGS. 29(*a*)-(*c*) illustrate top, perspective, and bottom views, respectively, of another exemplary embodiment of the present invention. FIGS. 30(*a*)-(*c*) illustrate top, perspective, and bottom views, respectively, of another exemplary embodiment of the present invention. FIGS. 31-33 illustrate perspective views of another exemplary embodiment of the present invention, i.e., a cup-mute.

FIG. 1 illustrates an exemplary embodiment mute for a horn-type musical instrument sometimes referred to herein as a conventional mute. Illustrated are a mute 10 comprising a freely resonating body 12 including an opening 14 (see e.g., FIGS. 5 and 10) to permit air flow into cavity 20 (see e.g., FIGS. 5 and 10) which is internal of body 12, instrument bell 16 (cut away/section view), and optional restraining pads/fitting means 18.

In this exemplary embodiment, mute 10 is adapted to fit at least partially into the bell 16 of an instrument to thereby change the timbre of the sound generated by the instrument and maintain the majority of the volume of the sound generated prior to placement of the mute into the bell of the instrument.

Body 12 may have n number of first facets 30 wherein n is an integer from 3 to 99, o number of second facets 50 wherein o is an integer from 1 to 99, and p number of end facets 70 wherein p is an integer from 0 and 99.

As illustrated in FIGS. 2(*a*)-(*c*), first facets 30 may have a multitude of surfaces such as inner surface 32 which faces the cavity of the mute and forms part of the surface surrounding the cavity, outer surface 34 which is on the exterior surface of the mute, first side surface 36, second side surface 38, third surface 40, fourth surface 42, and fifth surface 44.

In the illustrated embodiment, the facet may have two extended exterior first edges 35, 39, two extended interior edges 33, 37, one or more leading edges 49, 51 (i.e., if the first facet is tapered, sloped or curved, there may only be a single edge) and one or more shorter exterior edges 43, 47, and one or more shorter interior edges 41, 45. Note that the edges and/or surfaces may or may not be cambered, curved, sloped, etc. in a particular embodiment, though in some embodiments, such as that illustrated, the various surfaces may be angled with respect to other surfaces such that they may be paired with surfaces from adjoining facets (i.e, first, second or end facets). In some embodiments, such as that illustrated, inner surfaces 32 of each of the first facets may be generally planar. In some embodiments, inner surfaces 32 of each of the first facets may be planar with no curvature or surface variations. In other embodiments, there may be slight tapering of the surface such that it is not generally planar. In yet other embodiments, the inner surface may be slightly curved.

In some embodiments, a first side surface 36 of a first facet may be attached to a corresponding surface of another first facet. Such attachment may be by any suitable means. In some embodiments, the facets may be bonded, glued, nailed, tacked, welded, or otherwise permanently attached to each other. It is imperative that such attachment be airtight and permanent to create integrity and reliability in the mute and the mute's performance.

For the illustrated exemplary embodiment, the first facet is symmetrical about a plane P1 passing through the center of the facet (although it may also be symmetrical about other planes as well). Thus, surfaces 36 and 38 are mirror images of each other, as are surfaces 40 and 42 (as are their associated edges).

Note that although the exemplary first facet illustrated has seven (7) surfaces and a number of edges, it may have more or less surfaces and/or edges depending on the geometry of the desired mute. Further, in this embodiment, there is an optional taper edge 46, and, thus, a taper surface 48 (i.e., if there was no taper, then this could be surface 32.

FIGS. 3(*a*)-(*d*) illustrate various views of exemplary second facets 50. In this exemplary embodiment, second facets 50 may have a multitude of surfaces such as inner surface 52 which faces the cavity of the mute and forms part of the surface surrounding the cavity, outer surface 54 which is on the exterior surface of the mute, first surface 56, second surface 58, third surface 60, fourth surface 62, and fifth surface 64.

In the illustrated embodiment, the facet may have a number of interior edges 51, 53, 55, 57, 59, and a number of exterior edges 61, 63, 65, 67, 69. Note that the edges and/or surfaces may or may not be cambered, curved, sloped, etc. in a particular embodiment, though in some embodiments, such as that illustrated, the various surfaces may be angled with respect to other surfaces such that they may be paired with surfaces from adjoining facets (i.e, first, second or end facets). In some embodiments, such as that illustrated, inner surfaces 52 of each of the second facets may be generally planar. In some embodiments, inner surfaces 52 of each of the second facets may be planar with no curvature or surface variations. In other embodiments, there may be slight tapering of the surface such that it is not generally planar. In yet other embodiments, the inner surface may be slightly curved.

In some embodiments, a first surface 56 of a second facet may be attached to a corresponding surface 60 of another second facet. Further, in the embodiment illustrated in FIG. 1, surface 64 of second facet 50 may be attached to a surface 42 of a first facet and surface 62 may be paired with a surface 40 of a first facet, and so on and so on. Such attachment may be by any suitable means. In some embodiments, the facets may be bonded, glued, nailed, tacked, welded, or otherwise permanently attached to each other. It is imperative that such attachment be airtight and permanent to create integrity and reliability in the mute and the mute's performance.

For the illustrated exemplary embodiment, the second facet is symmetrical about a plane P2 passing through the center of the facet (although it may also be symmetrical about other planes as well). Thus, surfaces 56 and 60 are mirror images of each other, as are surfaces 62 and 64 (as are their associated edges).

Note that although the exemplary second facet illustrated has seven (7) surfaces and a number of edges, it may have more or less surfaces and/or edges depending on the geometry of the desired mute.

In the exemplary embodiment of FIG. 1, body 12 also has p number of end facets 70 wherein p is an integer from 0 to 99. In the illustrated embodiment, p is equal to one and an according exemplary end facet 70 is illustrated in FIGS. 4(*a*)-(*c*). As shown in FIGS. 4(*a*)-(*c*), end facets 70 may have an inner surface 72, outer surface 74, first side surface 76, second side surface 78, third side surface 80, fourth side surface 82, fifth side surface 84, and sixth side surface 86. In the illustrated embodiment, the facet may have a number of interior edges 71, 73, 75, 77, 79, 81, and a number of exterior edges 83, 85, 87, 89, 91, 93. Note that the edges and/or surfaces may or may not be cambered, curved, sloped, etc. in a particular embodiment, though in some embodiments, such as that illustrated, the various surfaces may be angled with respect to other surfaces such that they may be paired with surfaces from adjoining facets (i.e, first, second or end facets). In some embodiments, such as that illustrated, inner surfaces 72 of each of the end facet may be generally planar. In some embodiments, inner surface 72 of each of the end facets (if present) may be planar with no curvature or surface variations. In other embodiments, there may be slight tapering of the surface such that it is not generally planar. In yet other embodiments, the inner surface may be slightly curved.

In some embodiments, a surface of the end facet, such as surfaces 76, 78, 80, 82, 84, 86 of the end facet may be attached/paired to a corresponding surface 58 of a second facet as in the illustrated embodiment of FIG. 1. Such attachment may be by any suitable means. In some embodiments, the facets may be bonded, glued, nailed, tacked, welded, or otherwise permanently attached to each other. It is imperative that such attachment be airtight and permanent to create integrity and reliability in the mute and the mute's performance.

For the illustrated exemplary embodiment, the end facet is symmetrical about a plane P3 passing through the center of the facet (although it may also be symmetrical about other planes as well). In this particular embodiment, each of the side surfaces of the end facet are identical to all of the other side surfaces although such need not be the case for all embodiments.

Note that although the exemplary end facet illustrated has eight (8) surfaces and a number of edges, it may have more or less surfaces and/or edges depending on the geometry of the desired mute. In some embodiments, the first, second, and end facets may have a thickness of less than 1 inch and greater than 0.01 inch. In other embodiments, the first, second, and end facets may have a thickness of less than 0.5 inch and greater than 0.1 inch. In some embodiments, the first, second, and end facets may have a thickness of less than 0.3 inch and greater than 0.1 inch.

The sound that is produced by the instrument with the mute positioned at least partially into the bell of the instrument can be varied significantly by, among other factors, the geometry (such as for example, the thickness of the various mute members, the configuration of the facets) as well as by the material selected for the various mute components. In some embodiments, the mute may be comprised of a single materials including, but not limited to, wood, In some embodiments, the various mute components (i.e., first, second, and end facets (if present) may be comprised of two or more materials (such as, for example, walnut and oak, or two different species of walnuts, or carbon fibre and rubber). In other embodiments, the various components may be comprised of three or more materials (i.e., three different woods). Note that the fitting means may be of an entirely different material including, but not limited to, cork, rubber, and foam.

The various components of various exemplary embodiments of the mutes (i.e., first facets, second facets, third facets) may be attached or connected to each other by any suitable method including, but not limited to, sewing, tongue and groove, dovetailing, gluing, bonding, and welding.

In some embodiments, each of the first facets is permanently attached to at least two adjoining first facets and at least one second facet. In some embodiments, each of the first facets is permanently attached to at least two adjoining first facets and at least two second facets.

FIG. 5 illustrates a top view of an exemplary embodiment of the present invention. Shown are mute 10's first facets 30, opening 14 (into cavity 20), and a plane P about which the mute is symmetrical. Also illustrated are some optional fitting means 18 which may or not be included with mute 10. Note that the mute is also symmetrical about numerous other planes as well and that plane P is for illustration purposes only.

FIGS. 6-7 illustrate side views of the exemplary embodiment of FIG. 5. FIG. 8 illustrates a bottom view of the exemplary embodiment of FIGS. 5-7. FIG. 8 also illustrates one configuration for an end facet 70.

FIGS. 9-11 illustrate partial cut-away views of the exemplary embodiment of FIGS. 5-8. Shown is a partial view of cavity 20 and illustrating that the inner surfaces of the various facets form the boundary of cavity 20. FIG. 12 illustrates partial cut-away side view of the exemplary embodiment of FIGS. 5-11. FIGS. 13-15 illustrate additional perspective views of the exemplary embodiment of FIGS. 5-12.

FIG. 16 illustrates a perspective view of an exemplary embodiment of the present invention as a cup mute. Note that this embodiment illustrates second facets 100 which extend outward beyond their join with first facets 30 as well as third facets 120. Also illustrated are first facets 30 and end facet 70.

FIGS. 17-18 illustrate side views of the exemplary embodiment of FIG. 16. FIG. 19 illustrates a bottom view of the exemplary embodiment of FIGS. 16-18. FIGS. 20-23 illustrate partial cut-away perspective views of the exemplary embodiment of FIGS. 16-19. Note that FIG. 22 also illustrates some optional mounting holes 125 which may be used to provide anchor points for optional fitting means, thus, some embodiments will not have these sets of holes, while others may have such sets on multiple facets.

FIGS. 24-26 illustrate perspective views of the exemplary embodiment of FIGS. 16-23.

FIG. 27 illustrates a perspective view of the exemplary embodiment of FIGS. 16-26 in place on the bell of an instrument.

These figures illustrate an embodiment with three first facets 30 (i.e., where n is equal to 3) and three second facets 50 and no end facet.

FIGS. 28(*a*)-(*c*) illustrate top, perspective, and bottom views, respectively, of another exemplary embodiment of the present invention. Illustrated is an exemplary embodiment mute 200 with three first facets 230 (i.e., n=3), three second facets 250 (i.e., o=3), hole 14, and cavity 20 (internal to the body of the mute).

FIGS. 29(*a*)-(*c*) illustrate top, perspective, and bottom views, respectively, of another exemplary embodiment of the present invention. Illustrated is an exemplary embodiment mute 300 with three first facets 330 (i.e., n=3), three second facets 350 (i.e., o=3), hole 14, and cavity 20 (internal to the body of the mute).

FIGS. 30(*a*)-(*c*) illustrate top, perspective, and bottom views, respectively, of another exemplary embodiment of the present invention. Illustrated is an exemplary embodiment mute 400 with first facets 430, second facets 450, third facets 470, fourth facets 490, holes 14, and cavity 20 (internal to the body of the mute). In this exemplary embodiment, there may be two or more holes. Such holes may be of the same or different sizes and may be placed into any of the various facets. If there is only a single hole, then the fitting means 18 (such as cork) should be placed such that there are openings for air to pass between the bell of the instrument and the mute. However, if there is a continuous fitting means, such as a continuous cork band all the way around the mute as in some embodiments, then a second hole 14 may be provided in the mute to allow air to pass out of the mute to the outside.

FIGS. 31-33 illustrate perspective views of another exemplary embodiment of the present invention, i.e., a plunger-mute. Illustrated are exemplary first facets 530, second facets 550 and end facet 570, hole 14, and cavity 20 (internal to the body of the mute). Note that for this embodiment, the dimensions of the first facets are of different proportion to that of several of the other embodiments. This particular geometric configuration (which of course may be modified in dimension, number of facets, etc.) may be hand-held as well as utilized with fitting means.

As noted above, there may be various number of first facets, second facets and end facets for a specific embodiment mute of the present invention. In some embodiments, n (the number of first facets) is an integer from 3 to 99. In some embodiments, n is an integer from 3 to 10. In some embodiments, n is an integer from 5 to 8. In some embodiments, n is equal to 6. In some embodiments, o (the number of second facets) is an integer from 1 to 99. In some embodiments, o is an integer from 3 to 10. In some embodiments, o is an integer from 5 to 8. In some embodiments, o is equal to 6. Although several of the first facets, second facets and end facets described herein may be symmetrical, such configurations are not required and the various facets may be of different shape.

Mutes of the present invention may be made of any suitable material including, but not limited to, nylon, polymers, plastic, wood, aluminum, metal, carbon fiber, ceramics, acrylics, acrylic glasses, glass and rubber.

Mutes of the present invention may be made of any suitable dimensions and thicknesses. In some embodiments, the first facets may have a generally uniform thickness, whereas in other embodiments, the thickness may vary. In some embodiments, the second facets may have a generally uniform thickness, whereas in other embodiments, the thickness may vary. In some embodiments, the end facet(s) may have a generally uniform thickness, whereas in other embodiments, the thickness may vary.

Although various components of the present invention may be illustrated as being of a particular shape for convenience, such components may be of any suitable shape, configuration, orientation, etc. Further, any number of additional components may be added to a particular embodiment to accommodate a particular need, including, but not limited to, the addition of one or more straps or handles.

Note that there may be possible advantages of sloping or cutting away part of the material of one or more components, i.e., to utilize less material, or to decrease the weight of the device. As one of ordinary skill in the art would recognize, some advantage can be gained in using less material, but some minimum of material must be maintained to provide sufficient structural integrity for the device to be useful and for the device to produce a desired timbre for a particular instrument.

While the specification has been described in detail with respect to specific embodiments thereof, it will be appreciated that those skilled in the art, upon attaining an understanding of the foregoing, may readily conceive of alterations to, variations of, and equivalents to these embodiments.

What is claimed is:

1. A mute for a horn-type musical instrument, said mute comprising a freely resonating body including an opening therein to permit air flow into a cavity internal to said body, said body being adapted to fit at least partially into the bell of an instrument to thereby change the timbre of the sound generated by said instrument relative to said sound generated prior to placement of said mute into said bell of said instrument said body having n number of first facets wherein n is an integer from 3 to 99 and each of said first facets has a thickness of less than 1 inch and greater then 0.01 inch, said body having o number of second facets wherein o is an integer from 1 to 99 and each of said second facets has a thickness of less than 1 inch and greater then 0.01 inch, and wherein there is a central plane P about which the mute is symmetrical through a centerline of said body.

2. The mute of claim 1 wherein said mute further includes adjustable fitting means for retaining said mute on said instrument.

3. The mute of claim 1 wherein said mute is comprised of wood.

4. The mute of claim 1 wherein said mute is comprised of two or more woods.

5. The mute of claim 1 wherein each of said first facets is permanently attached to at least two adjoining first facets and at least one of said second facets.

6. The mute of claim 1 wherein n is greater than 2 and less than 10.

7. The mute of claim 1 wherein o is greater than 2 and less than 10.

8. The mute of claim 1 wherein an exterior surface of each of said first facets is generally planar.

9. The mute of claim 1 further comprising at least one end facet.

10. The mute of claim 1 wherein a perimeter of said exterior surface of each of said first facets has four or more edges.

11. The mute of claim 10 wherein two of said edges are at least twice as long as each of the remaining edges.

12. The mute of claim 1 wherein n is an even integer not less than 3 and no more than 10.

13. The mute of claim 1 wherein n is 6.

* * * * *